United States Patent [19]

Gorenflo et al.

[11] 3,989,094

[45] Nov. 2, 1976

[54] APPARATUS FOR PRODUCING CASTINGS FROM FLASKLESS SAND MOLDS

[75] Inventors: Donald L. Gorenflo, Marion; Dick D. Hendershot, Pleasant Township, Marion County; Oscar E. Ridenour, Marion Township, Marion County, all of Ohio

[73] Assignee: The Fairfield Engineering Company, Marion, Ohio

[22] Filed: Jan. 8, 1974

[21] Appl. No.: 431,773

[52] U.S. Cl. ..... 164/324; 164/328; 198/736

[51] Int. Cl.[2] ..... B22D 5/02; B65G 25/08

[58] Field of Search ..... 164/37, 323, 324, 329, 164/325, 344, 326; 193/35 SS, 36; 198/24, 221, 224

[56] References Cited

UNITED STATES PATENTS

| | | | |
|---|---|---|---|
| 2,713,703 | 7/1955 | Lasater | 164/401 X |
| 2,798,267 | 7/1957 | Anderson | 164/323 X |
| 2,823,791 | 2/1958 | Barrett | 198/224 |
| 2,864,516 | 12/1958 | Rodgers | 193/36 X |
| 3,123,871 | 3/1964 | Taccone | 164/323 X |
| 3,259,946 | 7/1966 | Blue | 164/344 |
| 3,273,210 | 9/1966 | Taccone | 164/344 X |
| 3,576,246 | 4/1971 | Hulet | 164/324 X |
| 3,612,159 | 10/1971 | Galinsky | 164/329 X |
| 3,782,527 | 1/1974 | Petershack | 193/36 X |

*Primary Examiner*—Francis S. Husar
*Assistant Examiner*—John S. Brown
*Attorney, Agent, or Firm*—Buell, Blenko & Ziesenheim

[57] ABSTRACT

A novel method and apparatus for high capacity production of castings from flaskless sand molds. A method and apparatus is provided wherein simple, inexpensive and easily maintained equipment is used and the pouring and cooling cycles of the castings are independent of the rate of green mold production.

5 Claims, 5 Drawing Figures

APPARATUS FOR PRODUCING CASTINGS FROM FLASKLESS SAND MOLD

This invention relates to a method and apparatus for high capacity production of castings from flaskless sand molds and particularly to a method and apparatus wherein mechanically simple, inexpensive and easily maintained parts are used and the pouring and cooling cycles of the castings are not limited by the rate of production of the sand molds. The invention provides a method and apparatus wherein green sand molds are received from an automatic molding machine; delivered to a pouring station; taken through a cooling loop; and then delivered for separation of sand from casting.

Methods and apparatus for producing castings in flaskless sand molds are not new in the art. However, the methods and apparatus used prior to the present invention suffer from serious drawbacks and limitations. In present methods the times for pouring and cooling the castings are governed by the rate of production of the green molds. This presents serious problems since a ladle and sufficient amounts of metal are not always available when a green mold is produced. Also, a delay in pouring necessitated by the unavailability of a green mold can result in the metal cooling forcing the remaining heat to be scrapped. In addition, the present apparatus in use is extremely complicated and requires nearly constant expensive maintenance during operation. Further, the methods and apparatus presently in use frequently damage the molds because of sliding transfer of the mold itself over the machine.

The invention of the present application overcomes the numerous limitations and drawbacks of the prior art. The pouring and cooling cycles for the castings are not limited by the production rate of the green molds. The apparatus of the present invention is constructed of relatively cheap, inexpensive and easily maintained structural parts. The apparatus and method can be adapted to the size and configuration of an individual foundry. In addition, since the cooling time is not limited by the rate of green mold production; cooling time may be varied to meet specific job needs. Also damage to the sand molds is minimized by retaining the mold on its original bottom board until separation.

In a preferred embodiment of our invention, we provide a roller conveyor which receives green sand molds on bottom boards from a storage area or a commercially available automatic mold machine. Pivoted pushers operably attached to the conveyor engage the bottom board and by means of a reciprocating motion advance the mold and board along the conveyor over the free rollers toward the weight-jacket lift station. While the green mold is advancing toward the weight-jacket lift station, a cast mold complete with weight-jacket enters the station from a cooling station by means of a conveyor of similar operation and construction which is at a right angle to the first conveyor. In the weight-jacket lift station, the forks of the scissor lift mechanism are below the level of the flanges of the mold jacket. The cast mold enters with the jacket flanges above the forks of the scissor lift mechanism. The forks are raised lifting the jacket and weight off and above the cast mold. The cast mold is then transferred at a right angle to its path of entry by pivoted pushers over a roller conveyor to a lowerator where it is transferred by a lift mechanism to a conveyor of similar operation and construction to those previously described. This conveyor line lies below the level of the other conveyors. The cast mold is transported over this conveyor to a station for final cooling and separation of the sand from the casting.

After the cast mold has left the weight-jacket lift station, the green sand mold which has been approaching the station enters. The scissors lifting mechanism which has just removed the weight-jacket from the cast mold is now lowered, placing the weight-jacket on the green sand mold. The forks of the scissor lift are lowered approximately 1 inch below the flanges on the jacket. The green mold complete with weight and jacket, then exits the station at a right angle to its path of entry over a roller conveyor to a pouring station. The cast mold will then proceed to a cooling station and await re-entry to the weight-jacket lift station to complete its cycle.

When the green mold has left the weight-jacket lift station, another cast mold enters, while a green mold is approaching and the process is repeated.

In the foregoing general description we have set out certain purposes, objects and advantages of our invention. It will be described hereafter and will become apparent for those skilled in the art of casting flaskless sand molds when considering the following description and the drawings in which.

Figure 1:
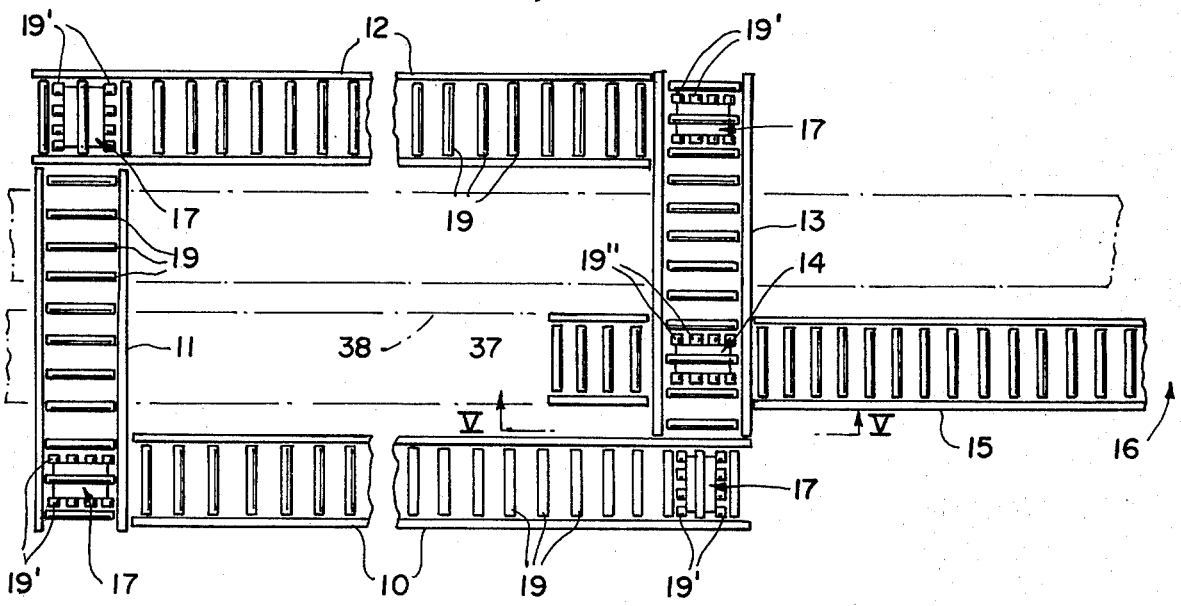
FIG. 1 is a plan view of the conveyor circuit system.

Referring to the drawings FIG. 1 shows three circuit feeder conveyors 10, 11 and 12. Conveyor 13 is a transfer conveyor so called since it carries the molds in and out of the weight-jacket lift station. Conveyor 15 is a standard free roller conveyor. Conveyors 10, 11, 12 and 13 are arranged to form a complete loop for transfer of the molds. The exact dimensions of the loop on its particular configuration can be altered to meet the specific needs of the foundry. Conveyor 15 feeds green molds from a storage area 16 into the weight-jacket lift station 14. Conveyors 10, 11, 12 and 13 each have a transfer area 17 in which the direction of travel of each mold is changed so it may proceed along the next conveyor.

Figure 4:
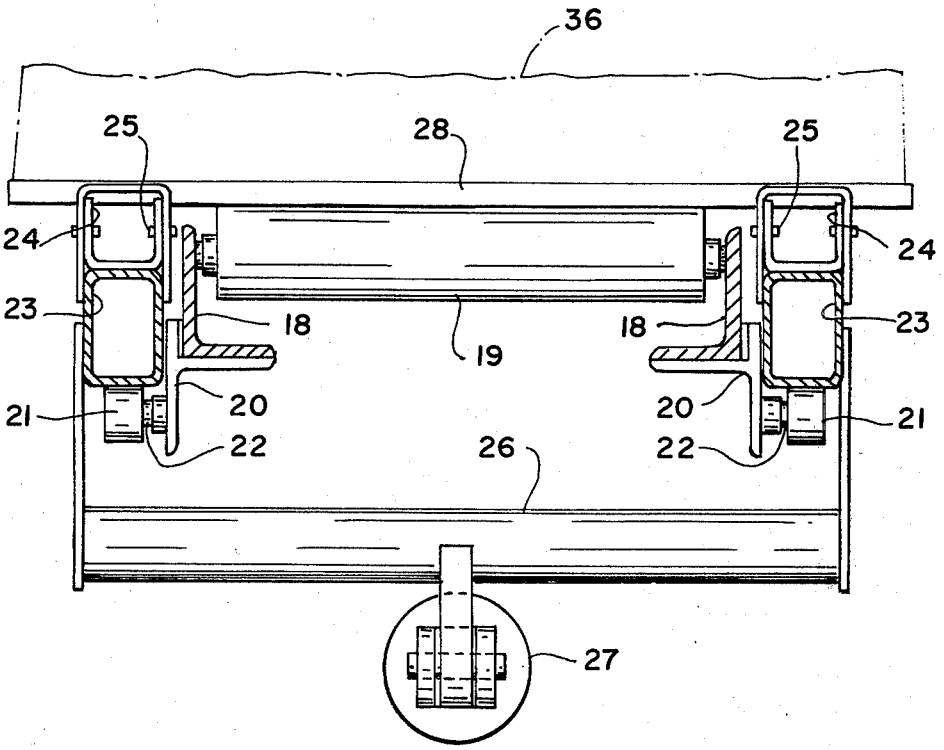
FIG. 4 is a transverse sectional view of FIG. 3 on the line IV—IV.

FIG. 4 depicts the construction of conveyors 10, 11 and 12. Structural angle side rails 18 support conventional free rollers 19 in the usual manner. Structural angles 20 are welded to the bottom of side rails 18. Guide rolls 21 are rotably attached to structural angles 20 by means of axles 22. Tubular push rods 23 are supported by and on guide rolls 21. Pivoted pushers 24 are attached to the push rods 23 by means of pin 25. Pushers 24 are constructed to have a greater mass below and to the rear of the point of rotation pin 25 on push rod 23 than above. Yoke assembly 26 is welded to the tubular push rods 23. Power cylinder 27 is connected to yoke 26 by means well known in the art. Conveyor 15 is of identical construction as circuit conveyor 10, 11 and 12 with the exception that there is no transfer area 17 and rollers 19' and attendant structure as described below.

In operation the forward stroke of power cylinder 27 cause pushers 24 to move forward and advance the molds forward one increment by engaging the bottom board 28 of the mold. The return stroke of power cylinder 27 causes pusher 24 to go under bottom boards 28. Another forward stroke of the power cylinder will advance the molds another increment.

Figure 2:
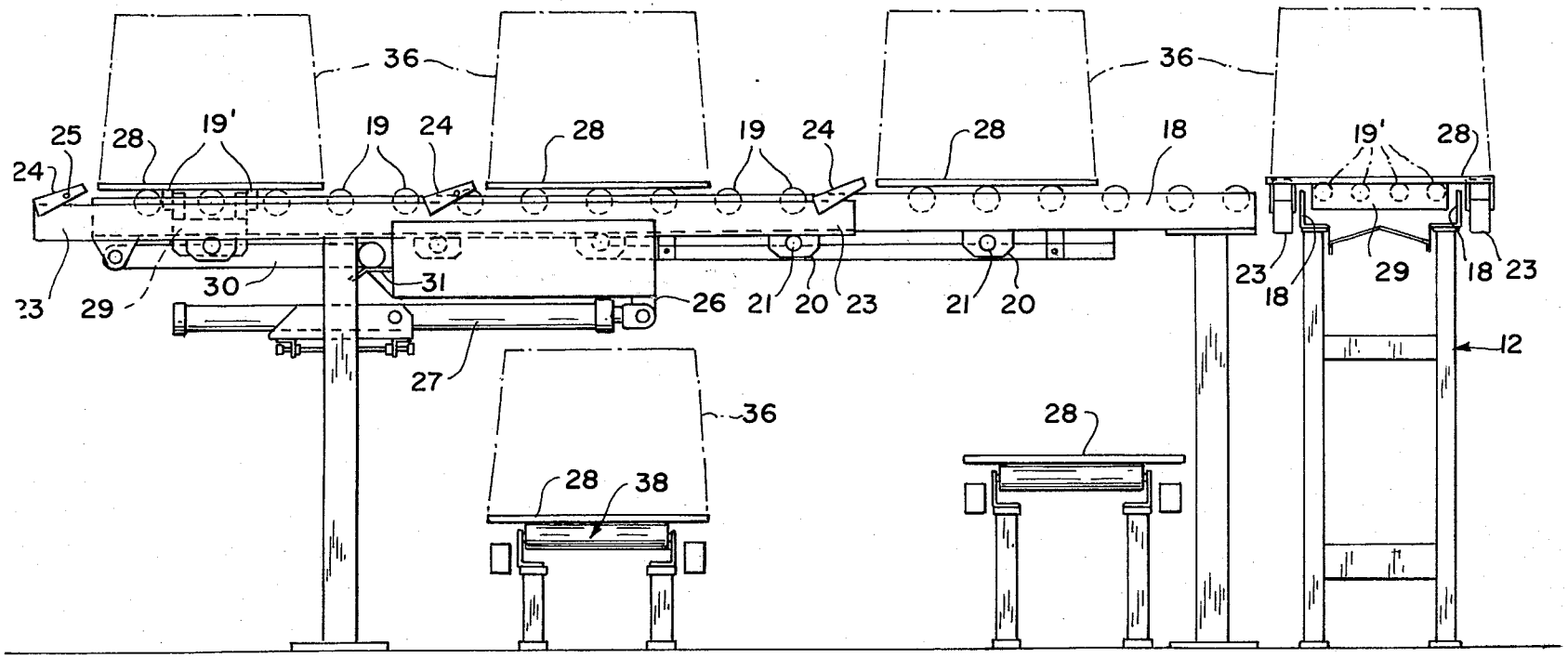
FIG. 2 is a side elevational view of a circuit conveyor.
Figure 3:
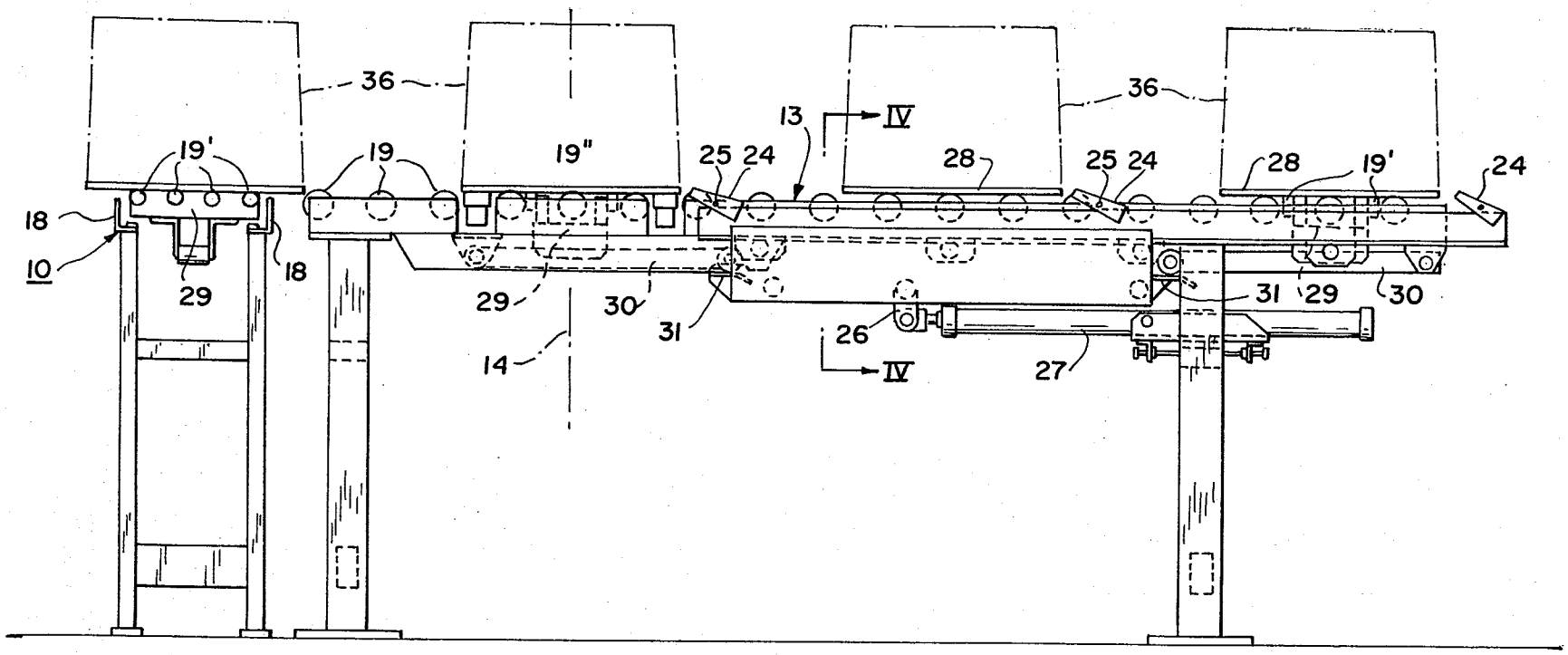
FIG. 3 is a side elevational view of a transfer conveyor.
Figure 5:
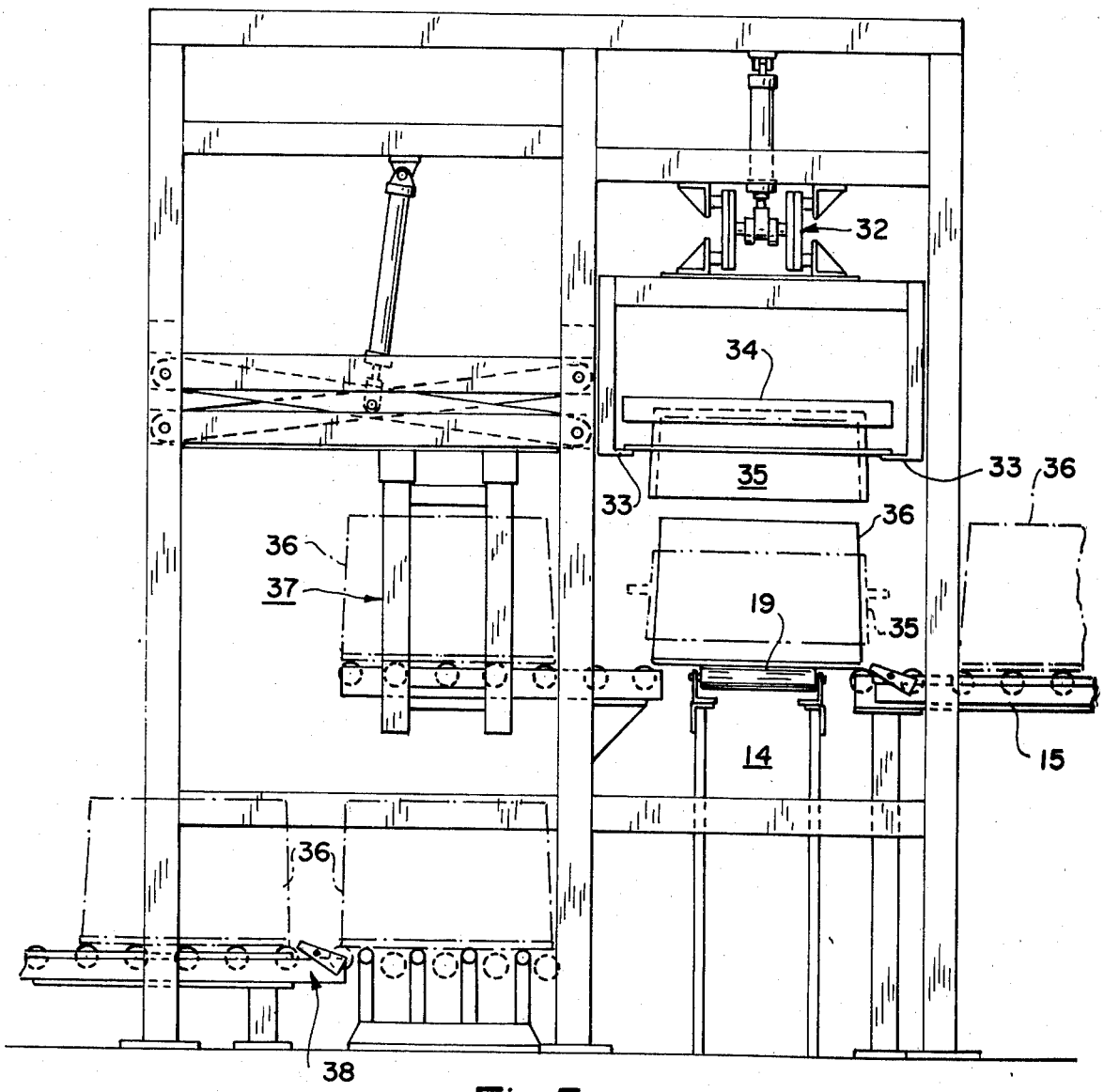
FIG. 5 is a side elevational view taken on line V—V of FIG. 1 showing weight-jacket lift station and lowerator.

The three circuit feeder conveyors 10, 11 and 12 shown in FIG. 2 and transfer conveyor 13 shown in FIG. 3 each have a transfer area 17. Rollers 19' are mounted in the conventional manner in carrier 29 which is pivotably mounted on link 30. Link 30 is pivotably attached to side rails 18 and is supported on cam plate 31 of yoke 26. Rollers 19' are mounted transverse to rollers 19 and the top surface of rollers 19' is approximately ⅛ inch above the surface of rollers 19. The forward stroke of power piston 27 lets link 30 fall which causes rollers 19' to fall below the level of rollers 19. The return stroke of power piston 27 causes cam follower 31 to re-engage link 30 and causes rollers 19' to return to their original elevation. Rollers 19'' in the weight-jacket lift station 14 are mounted in the same manner as rollers 19'. Rollers 19'' are caused to be raised and lowered in the same manner as rollers 19'.

Weight-jacket lift station 14 include a conventional scissor lift mechanism 32 having forks 33. The scissor lift mechanism is used to place and remove weights 34 and jacket 35 on the molds 36. Self-centering air pads are used to make lift mechanism 32 self-centering to compensate for misalignment caused by slight variations in the placement of the mold in the station.

Lowerator 37 is a conventional lift mechanism for molds and is used to lower the molds to a standard roller conveyor 38 after the weight and jackets have been removed in station 14. Conveyor 38 is at a level below the other conveyors and is of the same construction and mode of operation as conveyor 15.

In operation, a green mold 36 is taken from storage area 16 over conveyor 15. The forward stroke of power piston 37 causes yoke 26 to move forward causing push rods 23 to move forward, pivoted pushers 24 engage bottom board 28 of mold 33 and cause forward movement of the mold and bottom board. The return stroke of power piston 27 returns the yoke and push rods, pushers 24, due to the weighted construction, travel under the bottom board of the mold. A second forward stroke would again advance the mold and bottom board as described. While green molds are advancing toward weight-jacket station 14 of conveyor 15, a cast mold is simultaneously advancing over conveyor 13 to the weight-jacket lift station. Movement over conveyor 13 is by the same means as over conveyor 15.

Green mold 36 on board 28 enters station 14. A scissor lift mechanism 32 having weight 34 and jacket 35 suspended from forks 32 is lowered over the mold placing the weight and jacket on mold 36. Once the weight-jacket is placed on the green mold, the forks drop an additional 1 inch below the jacket flange.

Power piston 27 of conveyor 13 now makes its forward stroke. In doing so, rolls 19' and 19'' will be lowered, pushers 24 engage the bottom board 28 of the green mold and it is taken out of the weight-jacket lift station of conveyor 13; simultaneously a cast mold enters station 14. The cast mold has made the entire circuit starting at the storage area, going through station 14, a pouring and cooling area and is now returning to station 14 to have its weight-jacket removed. The scissor lift mechanism is raised removing the weight and jacket of the cast mold. After the scissor lift mechanism has been raised and the return stroke of piston 27 of conveyor 13 has been accomplished, the cast mold in station 14 is moved by pushers 14 to lowerator 37 and a green mold is placed in station 14 on to rollers 19'' which have raised on the return stroke of power piston 27 of conveyor 13.

Lowerator 37, which is a conventional scissor lift mechanism, lowers the mold to conveyor 38 for final cooling and separation of sand from casting. Scissor lift mechanism 32 lowers the weight 34 and jacket 35 taken from the cast mold onto the green mold which was moved into station 14 when the cast mold was placed on lowerator 37.

Transfer from conveyor 13 to conveyor 10 from conveyor 10 to conveyor 11 from conveyor 11 to conveyor 12 and from conveyor 12 to conveyor 13 operates in an identical manner to the transfer in and out weight-jacket lift station 14. For example, the forward stroke of power cylinder 27 of conveyor 13 would place a mold and bottom board on conveyor 10. The forward stroke of power piston 27 of conveyor 10 would bring forward cam follower 31 causing link 30 of basket 29 and rollers 19' of conveyor 10 to fall below the level of rollers 19 of conveyor 10. Thus pushers 24 would take the mold out of transfer area 17 of conveyor 10 and on to rollers forward of the transfer area on conveyor 10. The pouring of the casting is accomplished and the cast mold proceeds over the conveyor back to weight-jacket lift station 14. The operation is continuous as the return stroke of power piston 27 of conveyor 10 returns rollers 19' to the upper level to receive another mold from conveyor 13.

The cycle of operation includes the forward stroke of conveyor 15 places a green mold in station 14 and simultaneously pushes a cast mold from which the weight-jacket have been removed onto lowerator 37. The weight-jacket are now placed on the green mold. The forward stroke of conveyor 13 lowers rolls 19' and 19'', thus moving the green mold out of station 14, pushing a cast and solidified mold into the station and taking a mold from transfer area 17 on conveyor 13 on increment along conveyor 13. Also, the forward stroke of conveyor 13 places a green mold having its weight-jacket in transfer area 17 on conveyor 10. The power cylinder 27 of conveyor 10 makes its forward stroke lowering rolls 19' in its transfer area and pushing the mold forward toward the pouring and cooling stations. Simultaneously a mold is pushed into transfer 19' of conveyor 11. By sequential forward strokes of the cylinders of the conveyors the mold is transferred one increment at a time along the entire apparatus until it arrives back at station 14, has its weight-jacket removed and is pushed onto lowerator 37 for transfer to conveyor 38 while another green mold enters station 14 to receive the weight and jacket.

In the foregoing specification we have set out certain preferred embodiments of our invention, however, it will be understood that this invention may be otherwise embodied within the scope of the following claims.

We claim:

1. An apparatus for producing castings from flaskless sand molds comprising first conveyor means intersected with second conveyor means, hoist means at said intersection, said hoist means adapted to engage and disengage weights and jackets from sand molds, transfer means at said intersection from said first conveyor to said second conveyor and from second conveyor to mold transfer means, third conveyor means intersecting said second conveyor means, transfer means from said second conveyor means to said third conveyor at said intersection, fourth conveyor means intersecting said third conveyor means, transfer means from said third conveyor to said fourth conveyor at said intersection, fifth conveyor intersecting said fourth conveyor means, transfer means from said fourth conveyor to said fifth conveyor at said intersection, said fifth conveyor intersecting said second conveyor at a point removed from said intersection of said second and third conveyor means, transfer means from said fifth conveyor to said second conveyor, all of said conveyor means having power means operably connected to a plurality of pivoted pusher means, said pusher means being longitudinally spaced along said conveyor to operably engage the individual bottom boards of sand molds to cause forward movement of each individual board and sand mold while maintaining said boards in spaced relationship whereby contact between the individual boards is avoided; all of said conveyor means being adapted to carry sand molds.

2. The apparatus of claim 1 wherein said conveyor means include rotatably supported roller means.

3. The apparatus of claim 1 wherein said power cylinder means are operably connected to said transfer means, causing transfer of said molds from said transfer means.

4. The apparatus of claim 3 wherein said mold transfer means is hoist means located adjacent said second conveyor means for operably engaging said molds for transfer to sixth conveyor means, said sixth conveyor means being at a level below said previous conveyor means.

5. The apparatus of claim 1 wherein said transfer means at said intersection of said conveyor means include rotatably supported roller means.

* * * * *